US006152314A

United States Patent [19]

Besanko et al.

[11] Patent Number: 6,152,314

[45] Date of Patent: Nov. 28, 2000

[54] PORTABLE SHELF-TYPE DRYING RACK FOR USE WITH BASEBOARD HEATERS

[76] Inventors: Richard Lawrence Besanko; Carol Ann Besanko, both of 8 Bridle Path Way, Gorham, Me. 04038

[21] Appl. No.: 09/236,236

[22] Filed: Jan. 23, 1999

[51] Int. Cl.[7] ..... A47F 5/08; A47B 91/00

[52] U.S. Cl. ..... 211/134; 248/188.9

[58] Field of Search ..... 211/134, 186–188, 211/90.01, 90.04, 119.008, 119.009; 248/188.2, 188.8, 188.9, 501, 188.5; 312/236, 257.1; D32/58

[56] References Cited

U.S. PATENT DOCUMENTS

| | | | |
|---|---|---|---|
| Re. 20,327 | 4/1937 | Deal | 248/188.2 |
| D. 235,239 | 6/1975 | Cartwright | 211/90.04 X |
| 726,349 | 4/1903 | Richardson | 211/119.008 |
| 727,157 | 5/1903 | Lake | 211/119.008 |
| 1,237,967 | 8/1917 | Soans | 211/119.008 |
| 1,734,532 | 11/1929 | Sacerdote | 211/119.008 |
| 1,739,263 | 12/1929 | Sayers | 211/119.008 |
| 1,758,726 | 5/1930 | Webb | 211/90.01 |
| 2,107,629 | 2/1938 | Dallas | 248/188.2 |
| 2,560,497 | 7/1951 | Wallin | 211/163 |
| 2,919,818 | 1/1960 | Clegg et al. | 211/134 |
| 2,941,329 | 6/1960 | Apparius | 248/188.2 |
| 3,303,936 | 2/1967 | Barnawell | 211/134 |
| 3,538,842 | 11/1970 | Labbato | 211/90.04 |
| 3,892,189 | 7/1975 | Killam | 312/257.1 |
| 3,985,323 | 10/1976 | Gessler | 248/188.9 |
| 4,596,078 | 6/1986 | McCartney | 34/103 |
| 4,713,949 | 12/1987 | Wilcox | 211/134 |
| 4,746,021 | 5/1988 | Helmholdt et al. | 211/90.04 |
| 5,127,529 | 7/1992 | Martinez et al. | 211/37 |
| 5,148,928 | 9/1992 | Arnold | 211/187 |
| 5,176,266 | 1/1993 | Gillet | 211/90.04 |
| 5,408,936 | 4/1995 | Tseng | 211/90.04 |
| 5,505,318 | 4/1996 | Goff | 211/90.04 |
| 5,588,540 | 12/1996 | Schmit | 211/187 |
| 5,692,316 | 12/1997 | Antal | 211/34 X |

*Primary Examiner*—Daniel P. Stodola
*Assistant Examiner*—Jennifer E. Novosad
*Attorney, Agent, or Firm*—Nils Peter Mickelson

[57] ABSTRACT

A drying rack for placement over a baseboard heater provides convenient shelves for drying a variety of objects. The rack is provided with supports adapted to fit over and behind the baseboard heater.

7 Claims, 2 Drawing Sheets

PORTABLE SHELF-TYPE DRYING RACK FOR USE WITH BASEBOARD HEATERS

BACKGROUND OF THE INVENTION

This invention relates to the field of drying racks for use in the home, specifically for portable placement over a baseboard heater.

Dealing with wet outdoor clothing in the home has long been a problem. Shelf-type racks, with latticework shelves for the free passage of air, hold articles of wet clothing and may also serve as convenient general-purpose shelves. Drying is accelerated when warm air is supplied to the rack, and a common source of such air is the home heating system.

Prior art shows an evolution of adaptations for dealing with contemporary types of home heating systems, but few anticipate today's baseboard heaters. U.S. Pat. No. 5,692,316 to Antal (1996) discloses a shaped wire rack which may be placed over a baseboard heater. U.S. Pat. No. 5,127,529 to Martinez et al. reveals a wire rack adapted to rest on the floor over, and to fit under the edges of, a floor register used in the era of stove-type heating. U.S. Pat. No. 4,596,078 to McCartney teaches a plenum with tubes adapted to hold gloves and the like, also to fit over a floor register.

None of these provide shelf space for general use during good weather.

BRIEF SUMMARY OF THE INVENTION

To provide an attractive and useful shelf unit for drying wet clothing articles, our invention uses latticework horizontal shelves held by upright supports adapted for portable placement over baseboard heating units.

REFERENCE NUMERALS USED IN DRAWINGS

11 shelf

12 support

13 floor

14 wall

15 baseboard heater

16 extension

17 protrusion

18 adjustable fastener

DETAILED DESCRIPTION OF THE INVENTION

Where a rack stands freely on an unobstructed floor, legs of equal length serve well for support, but where the rack must be placed against a wall over a wall-mounted baseboard heater, the supports must be modified.

Figure 1:
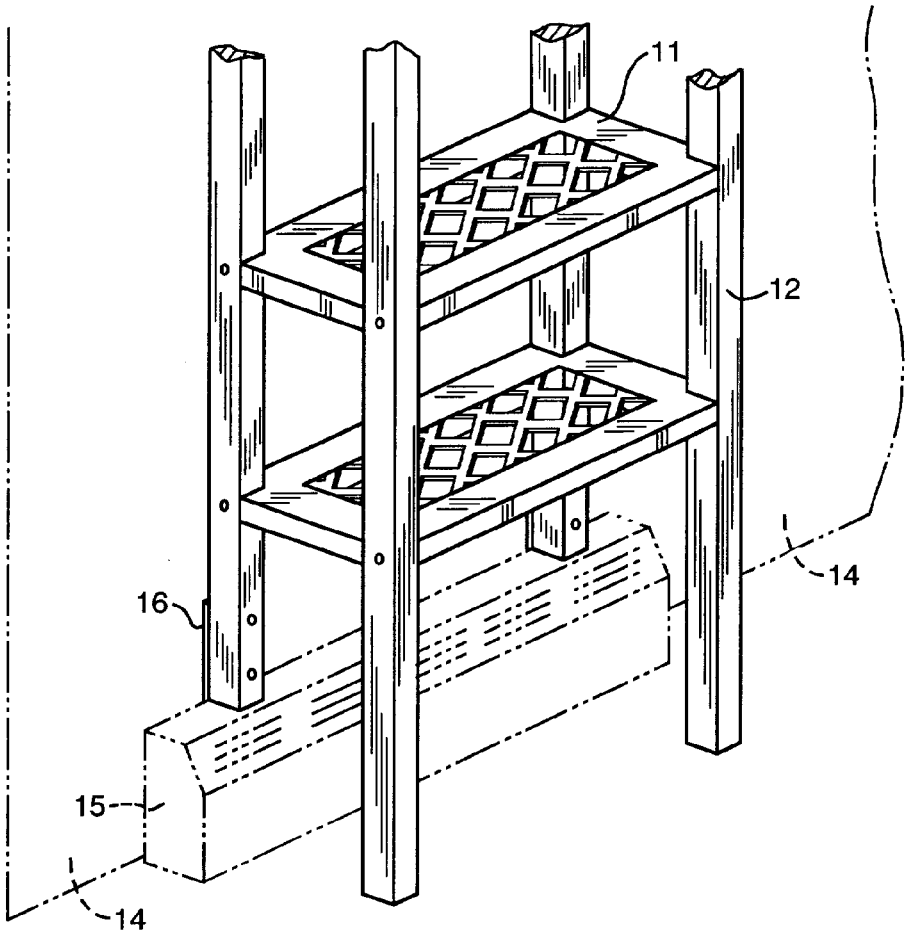
FIG. 1 provides an overall view of the preferred embodiment of our drying rack.

FIG. 1 depicts an overall view of the preferred embodiment of our drying rack. Two horizontal shelves 11 are each attached at their edges to four upright supports 12 using conventional fasteners, dowels, adhesive cement or the like, and the drying rack is placed on the floor against a wall 14 and over a baseboard heater 15.

Figure 2:
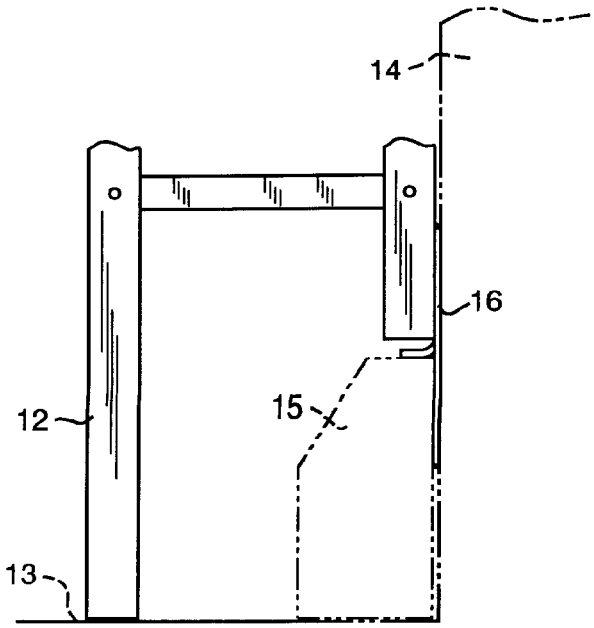
FIG. 2 shows an end view of the preferred embodiment.

FIG. 2 views the preferred embodiment of the drying rack from one end, showing that two of the four supports 12 are resting on the floor 13 while the other two supports 12 are shortened to rest above the baseboard heater 15. Extensions 16 are attached by bolts, screws, adhesive cement or the like, to the shortened supports 12 and extend downward behind the baseboard heater 15, between it and the wall 14, to prevent the drying rack from moving away from the wall.

Figure 3:
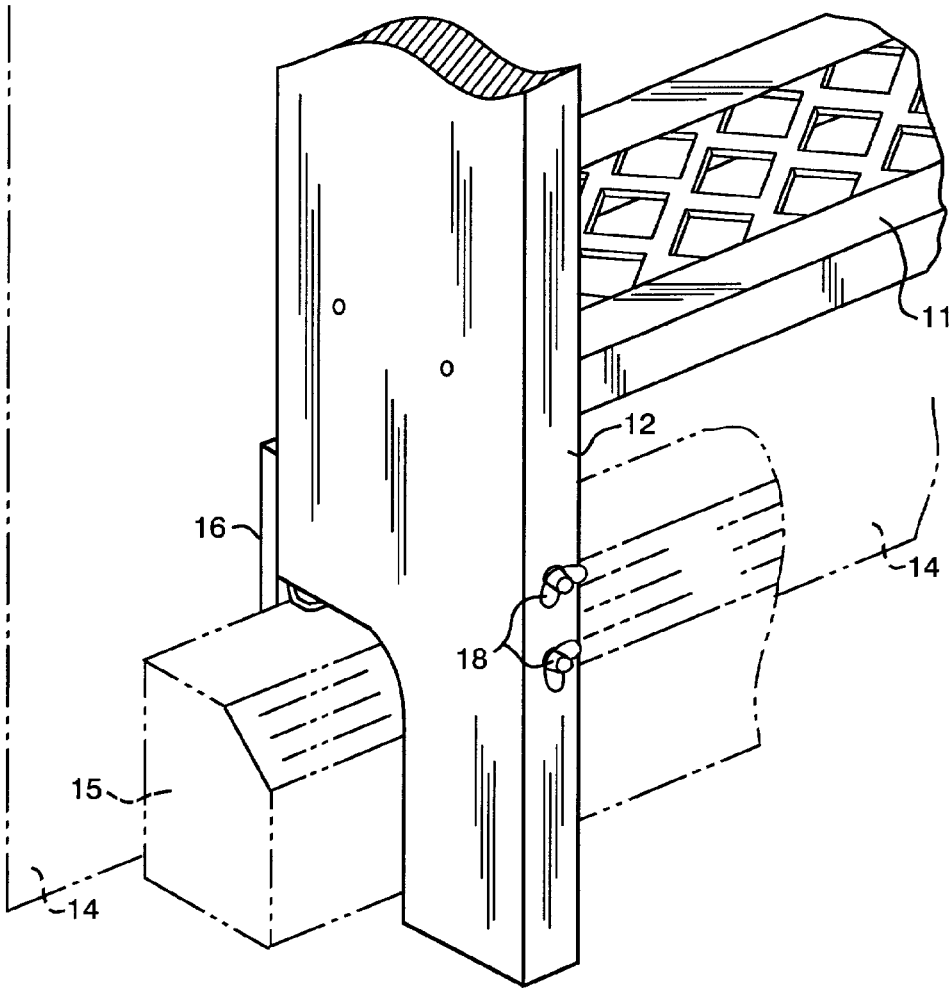
FIG. 3 illustrates an overall view of an alternate embodiment.

In the alternative embodiment shown at FIG. 3, one horizontal shelf 11 is shown attached to one of two upright supports 12 using conventional fasteners, dowels, adhesive cement or the like, and the drying rack is shown placed as in FIG. 1. In this embodiment, supports 12 are relieved in contour to clear the baseboard heater 15, and extensions 16 are attached by adjustable fasteners 18 such as bolts and wingnuts, or the like, to the edges of supports 12 nearest the wall 14.

It may be understood that heated air from the baseboard heater 15 will rise by convection, and because in the preferred embodiment the shelf or shelves 11 are open as with latticework, perforated metal, screening or the like, the air will pass freely upward through the shelves, drying any articles placed thereon. When not used for drying, these horizontal shelves may be alternatively used for such general purposes as holding books or plants. Indeed the drying rack will function, though much less effectively, even if the shelves are solid, because rising air will generally circulate around the articles on the shelves.

Figure 4:
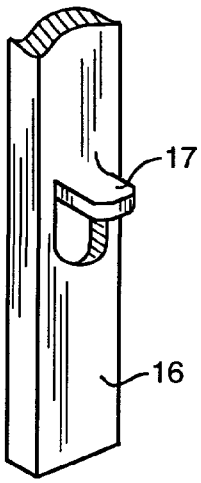
FIG. 4 gives a detailed view of an alternative extension.

Since friction between the supports 12 and the floor 13 may vary greatly from one installation to another, extensions 16 are used in the preferred embodiment to prevent motion away from the wall 14 or to carry weight to the top of the baseboard heater 15, whose height may vary from one type or from one installation to another. To help in transferring weight to the top of a variety of baseboard heaters 15, extension 16 may be provided with a protrusion 17, best seen in FIG. 4, extending perpendicularly thereto which may be adjusted with extension 16 to rest on the baseboard heater 15. As shown in FIG. 4, protrusion 17 is an integral lanced portion of extension 16, but protrusion 17 could as well be a separate part such as a welded bracket, through-bolt, or the like. Where friction on the floor is adequate, extensions 16 may be omitted.

Though the above description is necessarily specific, many alternatives to materials and structure may be used to accomplish the same results. The scope of our invention should be determined by the appended claims rather than by the specific embodiments recited above.

What is claimed is:

1. A drying rack for portable placement on a floor and superjacent to a wall-mounted baseboard heater comprising:

(a) at least one horizontal shelf having a plurality of edges, one of said edges for placement against a wall;

(b) a plurality of upright supports each having a lower end, each said support attached to at least one of said edges of said at least one shelf;

(c) at least one of said supports being shaped such that said lower end does not directly interfere with a top portion of the baseboard heater; and (d) at least one extension;

whereby said at least one extension extends downwardly from at least one of said supports such that said at least one extension is adapted to extend downwardly to a point between the baseboard heater and a wall to which the baseboard heater is adjacent.

2. The drying rack of claim 1 wherein said at least one extension further comprises a perpendicular protrusion.

3. The drying rack of claim 2 wherein said at least one extension is adjustably attached to at least one of said supports to permit adjustment for accommodating baseboard heaters of varying heights.

4. The drying rack of claim 1 wherein said at least one shelf is open so as to allow the passage of air therethrough.

5. The drying rack of claim 1 wherein there is the absence of fastening means for fastening the rack to the wall.

6. The drying rack of claim 5 wherein said at least one shelf is open so as to allow the passage of air therethrough.

7. A drying rack for portable placement on a floor and superjacent to a wall-mounted baseboard heater comprising:

(a) a plurality of horizontal shelves each being of open construction so as to allow the passage of air therethrough and each having a plurality of edges, one of said edges for placement against a wall;

(b) a plurality of upright supports each having a lower end, each of said supports attached to at least one of said edges of each of said shelves;

(c) at least one of said supports being shaped such that said lower end does not directly interfere with a top portion of the baseboard heater; and (d) at least one extension;

whereby said at least one extension extends downwardly from at least one of said supports such that said at least one extension is adapted to extend downwardly to a point between the baseboard heater and a wall to which the baseboard heater is adjacent.

* * * * *